US009119426B1

(12) United States Patent
Skanron

(10) Patent No.: US 9,119,426 B1
(45) Date of Patent: Sep. 1, 2015

(54) REMOVABLE ELASTIC PIECE FOR A MATERNITY GARMENT

(76) Inventor: Jennifer Skanron, Pleasant Prairie, WI (US)

( * ) Notice: Subject to any disclaimer, the term of this patent is extended or adjusted under 35 U.S.C. 154(b) by 0 days.

(21) Appl. No.: 13/215,053

(22) Filed: Aug. 22, 2011

Related U.S. Application Data

(60) Provisional application No. 61/429,327, filed on Jan. 3, 2011.

(51) Int. Cl.
*A41F 9/00* (2006.01)
*A41D 1/20* (2006.01)

(52) U.S. Cl.
CPC .... *A41D 1/20* (2013.01); *A41F 9/00* (2013.01)

(58) Field of Classification Search
CPC ..... A41F 9/00; A41F 9/02; A41F 9/025; A41D 1/20; A41D 2400/38; A41D 1/10
USPC ..... 2/109, 112, 234, 235, 236, 237, 311, 2/312, 320, 338, 337, 221, 220, 222
See application file for complete search history.

(56) References Cited

U.S. PATENT DOCUMENTS 887,610 A * 5/1908 Epstein ..... 2/221
1,091,294 A * 3/1914 Clark ..... 2/312
1,120,814 A * 12/1914 Hebbard ..... 2/106
1,149,271 A * 8/1915 Lazarus ..... 2/237
1,174,976 A * 3/1916 Gaines ..... 2/221
1,286,798 A * 12/1918 Scheinman ..... 2/221
1,307,010 A * 6/1919 Kinsman ..... 2/400
1,463,553 A * 7/1923 Lasater ..... 2/221
1,614,898 A * 1/1927 Randolph ..... 2/117
1,712,072 A * 5/1929 Dodson ..... 2/404
1,737,882 A * 12/1929 Hatch ..... 2/237
1,812,593 A * 6/1931 Karberg ..... 2/237
1,823,296 A * 9/1931 Sekey ..... 2/237
2,130,942 A * 9/1938 Blumberg ..... 2/236
2,334,144 A * 11/1943 Bono ..... 2/235
2,347,354 A * 4/1944 Leubrie ..... 2/235
2,349,019 A * 5/1944 Terrell ..... 2/221
2,366,031 A * 12/1944 James ..... 2/236
2,418,772 A * 4/1947 Jackson ..... 2/235
2,770,810 A * 11/1956 De Grazia ..... 2/236
2,787,792 A * 4/1957 Mikottis ..... 2/221
2,873,452 A * 2/1959 Jacobs ..... 2/221
2,903,707 A * 9/1959 Schimmel et al. ..... 2/221
3,013,277 A * 12/1961 Satin ..... 2/221
3,089,149 A * 5/1963 Kelleam ..... 2/221
3,258,783 A * 7/1966 Martin ..... 2/221
3,431,562 A * 3/1969 Souders ..... 2/221
3,487,418 A * 12/1969 Jacobs ..... 2/221
3,505,685 A * 4/1970 Granchelli ..... 2/221
4,139,913 A * 2/1979 Garin et al. ..... 2/237
4,280,229 A 7/1981 Stein (Continued)

FOREIGN PATENT DOCUMENTS

EP 1 629 737 A2 3/2006
JP 2003027306 A 1/2003

*Primary Examiner* — Alissa L Hoey
(74) *Attorney, Agent, or Firm* — Jean Kyle

(57) ABSTRACT

A removable elastic piece is placed in the waistband of a garment to allow the garment to be worn throughout pregnancy. An elastic band covers the expanding belly of the wearer and holds the garment up. The elastic band can be removed from the garment in early pregnancy or postpartum when it is not needed.

7 Claims, 3 Drawing Sheets

(56) References Cited

U.S. PATENT DOCUMENTS

| | | | | |
|---|---|---|---|---|
| 4,364,124 | A * | 12/1982 | Barna | 2/234 |
| 4,506,390 | A | 3/1985 | Stern | |
| 4,620,326 | A * | 11/1986 | Matthias, Jr. | 2/221 |
| 4,803,740 | A * | 2/1989 | Dawson | 2/215 |
| 5,127,108 | A * | 7/1992 | Weiss | 2/237 |
| 5,141,141 | A * | 8/1992 | Leone | 224/587 |
| 5,163,184 | A * | 11/1992 | Reardon | 2/237 |
| 5,217,403 | A * | 6/1993 | Nobbs | 450/155 |
| 5,283,910 | A * | 2/1994 | Flint | 2/76 |
| 5,638,550 | A * | 6/1997 | Hube | 2/311 |
| 5,819,320 | A | 10/1998 | Jolla | |
| 5,902,170 | A * | 5/1999 | Ganz | 450/94 |
| 5,946,730 | A * | 9/1999 | Blair | 2/227 |
| 6,108,819 | A * | 8/2000 | DeBaene et al. | 2/227 |
| 6,219,848 | B1 * | 4/2001 | Russell | 2/221 |
| 6,308,338 | B1 * | 10/2001 | Caldwell | 2/312 |
| 6,311,333 | B1 * | 11/2001 | Batra | 2/237 |
| 6,385,777 | B1 * | 5/2002 | Hamada et al. | 2/221 |
| 6,620,026 | B1 * | 9/2003 | Guilani et al. | 450/155 |
| 6,735,785 | B2 * | 5/2004 | Takayama | 2/236 |
| 7,181,775 | B2 | 2/2007 | Carney | |
| 7,516,499 | B2 * | 4/2009 | Gardner, III | 2/221 |
| 7,676,852 | B1 * | 3/2010 | Carney | 2/311 |
| 7,814,575 | B2 | 10/2010 | Hendrickson et al. | |
| 7,908,677 | B1 * | 3/2011 | Montgomery | 2/338 |
| D644,412 | S * | 9/2011 | Reuther | D2/714 |
| 8,191,177 | B1 * | 6/2012 | Carney | 2/311 |
| RE43,563 | E * | 8/2012 | Hendrickson et al. | 2/237 |
| 8,266,723 | B2 * | 9/2012 | Frandsen et al. | 2/311 |
| 8,276,216 | B2 * | 10/2012 | Carney | 2/311 |
| 2004/0049834 | A1 * | 3/2004 | Stangle et al. | 2/338 |
| 2004/0163159 | A1 * | 8/2004 | Edwards et al. | 2/338 |
| 2004/0210987 | A1 * | 10/2004 | Carney | 2/236 |
| 2005/0268379 | A1 * | 12/2005 | MacGeorge | 2/400 |
| 2006/0010571 | A1 | 1/2006 | Oakley | |
| 2007/0028364 | A1 * | 2/2007 | Oomae | 2/237 |
| 2008/0172769 | A1 * | 7/2008 | Herget | 2/76 |
| 2008/0301855 | A1 * | 12/2008 | Ball | 2/237 |
| 2009/0049583 | A1 * | 2/2009 | Stones | 2/221 |
| 2009/0049584 | A1 * | 2/2009 | Stones | 2/221 |
| 2009/0210996 | A1 * | 8/2009 | Hu | 2/228 |
| 2009/0235431 | A1 * | 9/2009 | Bevley | 2/227 |
| 2010/0000004 | A1 * | 1/2010 | Levac et al. | 2/108 |
| 2010/0235965 | A1 * | 9/2010 | Frandsen et al. | 2/237 |
| 2011/0004976 | A1 * | 1/2011 | MacGillivray | 2/221 |
| 2011/0059678 | A1 * | 3/2011 | Agassi et al. | 450/154 |
| 2011/0061147 | A1 * | 3/2011 | Welfeld | 2/237 |
| 2011/0239353 | A1 * | 10/2011 | Carney | 2/311 |

* cited by examiner

REMOVABLE ELASTIC PIECE FOR A MATERNITY GARMENT

CROSS-REFERENCE TO RELATED APPLICATIONS

This application claims the benefits of U.S. Provisional Application No. 61/429,327, filed Jan. 3, 2011, the disclosure of which is hereby incorporated by reference in its entirety including all figures, tables and drawings.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

Pregnancy is an exciting time. For a working mother however, it can be costly and uncomfortable. In order for a career woman who becomes pregnant to stay looking professional it may be necessary for her to buy several suits in several sizes to get her through the pregnancy. The changing shape of a pregnant woman's body however cannot always be addressed with just buying a larger size leaving the pregnant mom-to-be looking sloppy and unprofessional. Few maternity suits are available, and those suits do not necessarily address all the issues of a pregnant woman's body during and soon after pregnancy.

Many maternity garments are not suitable for business situations. They contain permanent maternity panels that can be bulky and cumbersome during early pregnancy (see, for example, U.S. Pat. Nos. 4,280,229; 4,506,390; 7,814,575 B2; and U.S. Patent Application Publication No. 2006/0010571 A1; and European Patent Application No. 1 629 737 A2). A pregnancy band is available but can slip because it is not attached to the article of clothing (U.S. Pat. No. 7,181,775 B2). Allowing a belly band to be detached from a garment would make the garment truly versatile during all stages of pregnancy. Trousers with a zipper detachable waistband is described in U.S. Pat. No. 5,819,320 ('320). In the '320 patent, the waistband of the trousers carrying the gun belt is detachable from the uniform trouser of a police officer.

A need remains for maternity wear that is adaptable to a woman's body during all stages of pregnancy including post-partum. Suit components should adjust to the changing shape of the wearer yet convey a professional, fitted look.

All patents, patent applications, provisional patent applications and publications referred to or cited herein, are incorporated by reference in their entirety to the extent they are not inconsistent with the teachings of the specification.

BRIEF SUMMARY OF THE INVENTION

The invention involves a maternity garment that adapts to the changing body of a pregnant woman. Pants or a skirt have an elastic band that zips into the waistband. The band keeps the pants or skirt in place without need for suspenders or a belt.

DETAILED DESCRIPTION OF THE INVENTION

Figure 1:
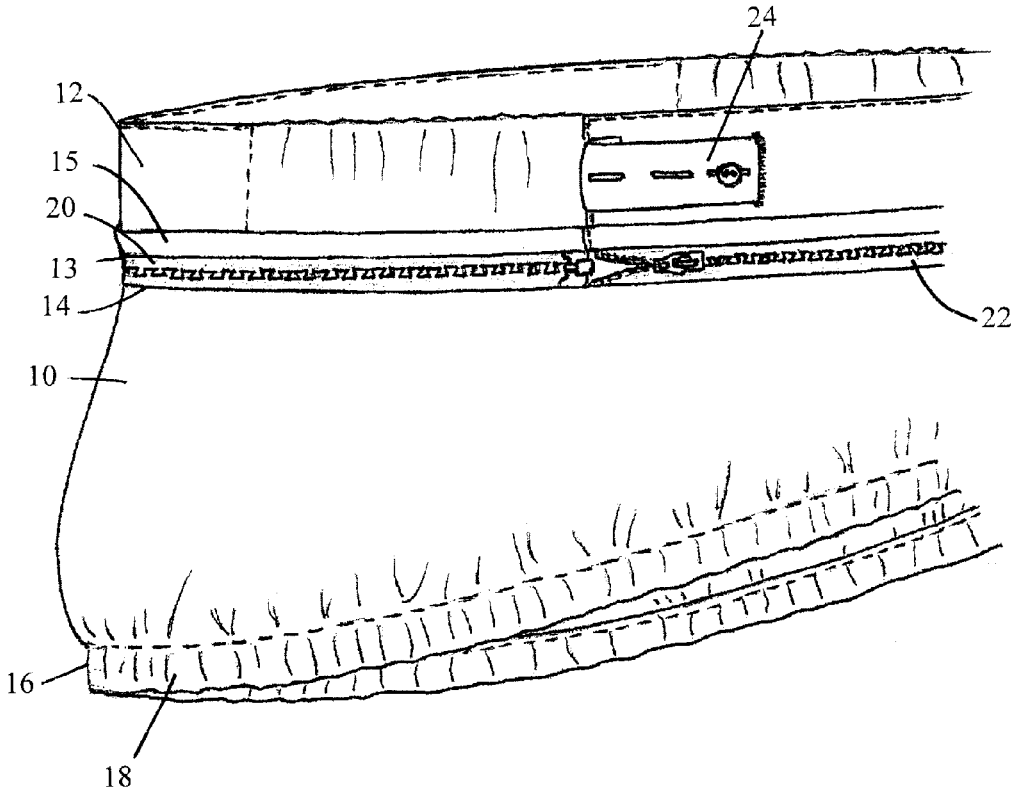
FIG. 1 is a partial view of a pair of pants everted to show a preferred embodiment of the removable elastic piece for a maternity garment of the subject invention.
Figures 2A, 2B, 2C:
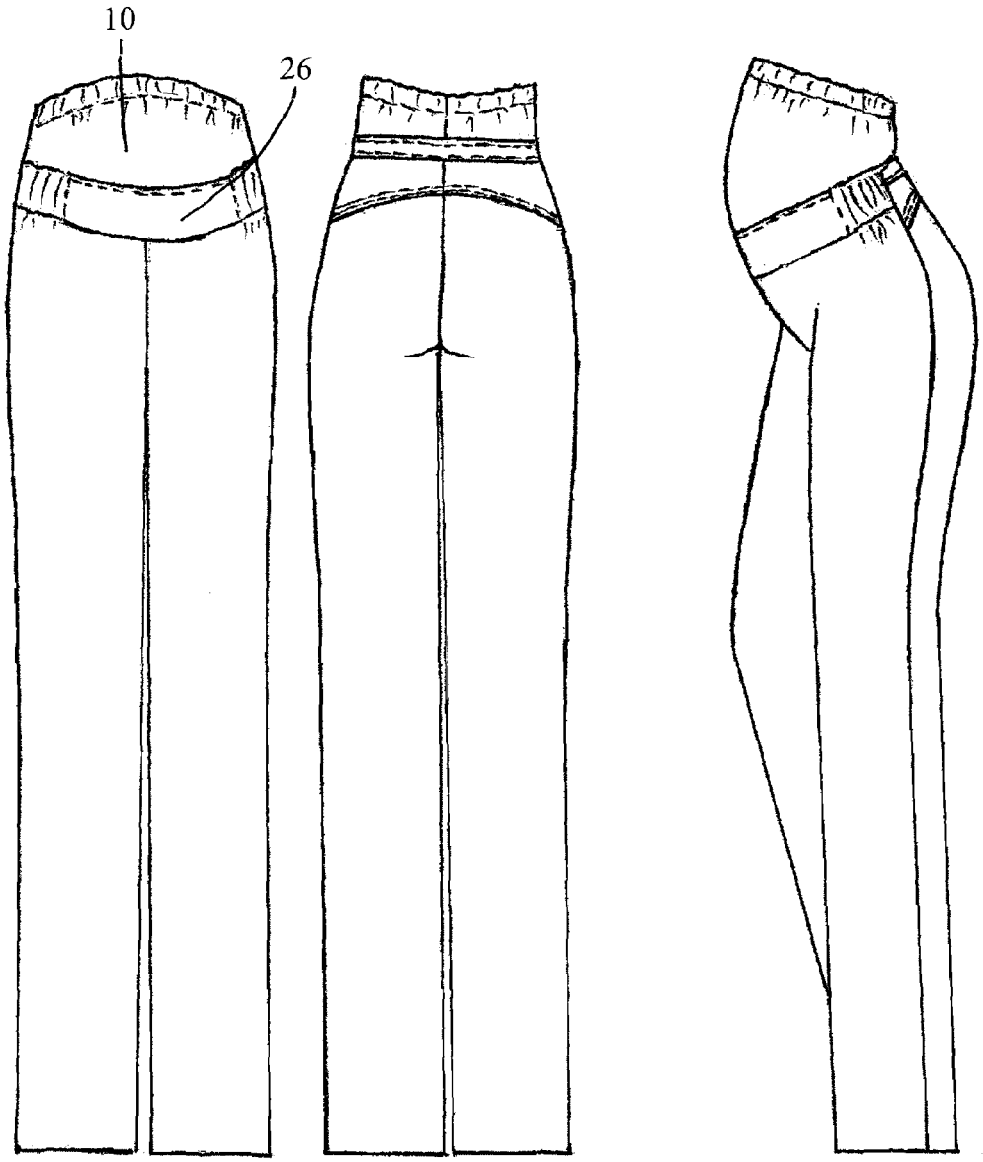
FIG. 2A is a front elevational view of a pair of pants with a preferred embodiment of the removable elastic piece of the subject invention.
FIG. 2B is a rear elevational view of the pair of pants shown in FIG. 2A.
FIG. 2C is a side elevational view of a pair of pants shown in FIG. 2C.
Figure 3:
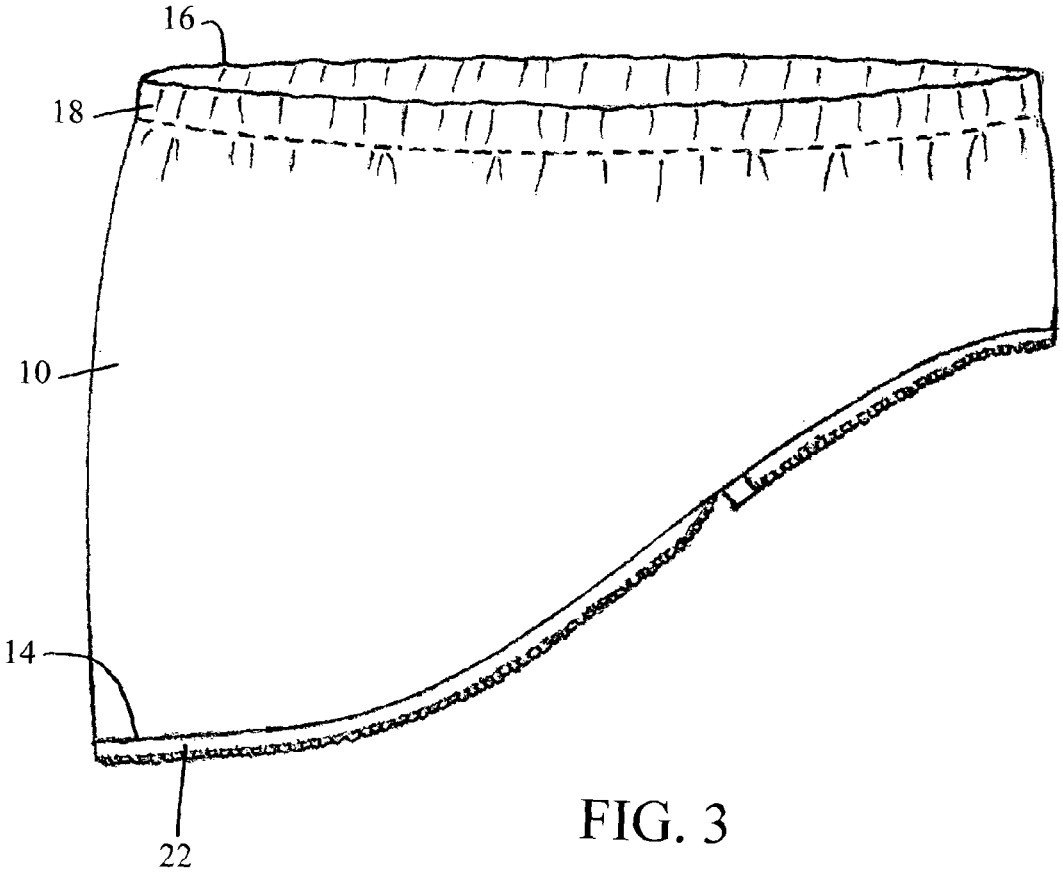
FIG. 3 is side elevational view of a preferred embodiment of an elastic piece for a maternity garment of the subject invention.

The invention involves a maternity garment that adapts to the changing body of a pregnant woman through a removable elastic band zipped into the waistband of a pair of pants or a skirt.

The removable elastic piece can be applied to or removed from the waistband 12 of a garment as the figure of a pregnant woman changes. A band 10 is elastic capable of stretching over the expanding belly. As a pregnant woman's body changes, her expanding belly pushes the waistband of her pants down making it difficult for her to hold her pants up. The band of the piece of the subject invention stretches over the belly disposing of the need for suspenders or a belt. The band is made of a stretch-type fabric know in the art, for example, spandex. The band is generally cylindrical to fit into the waistband of a pair of pants or a skirt. An edge 14 of the cylinder is removably attached to an inside bottom edge 13 of the waistband 12 of the garment. The opposite edge 16 is positioned near the waist of the wearer. Preferably, this edge 16 is reinforced to hold the band around the wearer's waist. In the exemplified embodiment, the opposite edge 16 has an elastic band 18 sewn into the edge to reinforce its elastic qualities. One skilled in the art would realize that elasticity of the edge can be reinforced in a variety of ways including, but not limited to, increasing the elastic weave of the material near the edge.

One edge 14 of the cylindrical band is configured to be removably attached to an inside bottom edge 13 of the waistband 12 of a garment. The garment can have a receiving means 20 to receive a removable attachment means 22 on the band. The band should be removably attached to the garment with sufficient strength to hold the band to the garment as it is stretched over a pregnant belly. Preferably, the band is attached to the garment so it is simple to detach and lies smooth under the waistband for the comfort of the wearer and to create an appealing look. The band can be attached to the garment by means, including but not limited to, a zipper, buttons, snaps, hook and loop tape or pieces, and sliderless plastic zippers. In a particularly preferred embodiment, the band is attached to the garment by a small nylon zipper. The smooth edges of the nylon zipper are easily hidden by a seam and comfortable to wear. Additional comfort is provided by attaching a fly 15 to the inside bottom edge 13 of the waistband. The fly 15 covers the one half of the zipper 20 when the band is not attached preventing it from chafing the wearer. A zipper is a reliable, sturdy means to attach the band. Further, a zipper is easy to operate. One skilled in the art recognizes that one half of the zipper is attached to an edge of the elastic band and the other half of the zipper is sewn into the waistband of the garment.

In the exemplified embodiment, the garment is not only configured to receive the band but is constructed for the comfort and convenience of the changing body of a pregnant woman. The pant is tailored with an elastic waist. Buttoned elasticized tabs 24 on each side of the waist provide extra stretch for the waistband. At the side seams of the pants, the waistband widens. A central stiffened panel 26 is flanked by two wide elastic pieces. The exemplified waistband will not roll under the pressure of an expanding belly.

The removable band of the subject invention allows a professional woman to buy and wear a single suit throughout her pregnancy. Pants or a skirt with the removable band can be paired with a jacket that is likewise convertible. For example, the jacket shown in JP2001216883 has zippers at the seams allowing it to be let out as the pregnant woman's body changes. Both that jacket and the garment with removable band of the subject invention can be made of high quality suit material and constructed to provide a tailored, well-made, professional suit.

The subject disclosure describes a garment with a removable elastic piece that is made from quality material and can be used as part of a professional business suit. Applicant notes however that the subject piece can be incorporated into any garment, professional, formal, or casual, meant to be worn as bottoms. For example, garments that can have the removable elastic piece of the subject invention include, but are not limited to, shorts, capris, and skorts.

Although the subject invention has been described for use by a pregnant woman during her pregnancy, the removable band can be used for any situation were rapid weigh loss or weight gain is anticipated. In some instances, the band can even provide support for the abdomen. For example, support of the abdomen may be necessary after injury or surgery. Further, although the garment of the subject invention has been described for temporary use while the wearer's size fluctuates, the claimed garment with the removable elastic band could be used in plus-size clothing. The subject band functions in the same manner preventing a skirt or pants from falling down and could, for example, allow current styles to accommodate different body shapes.

The removable band of the subject invention allows a professional woman to adapt a suit to her changing body during pregnancy. The band allows the suit garment to be comfortably adjusted to her swelling belly. Its configuration holds the garment in place so there is no need for suspenders or belts.

It is understood that the foregoing examples are merely illustrative of the present invention. Certain modifications of the articles and/or methods may be made and still achieve the objectives of the invention. Such modifications are contemplated as within the scope of the claimed invention.

The invention claimed is:

1. A maternity garment comprising:

an article of clothing having a front and back, the article of clothing comprising a waistband, the waistband including a central stiffened panel at the front of the garment, the central stiffened panel flanked by elastic pieces on each side of the stiffened panel, and a zipper half along an inside of the waistband on the front of the garment and along an inside bottom edge of the waistband on the back of the garment;

a generally cylindrical elastic band capable of expanding around a pregnant woman's belly, the elastic band having a bottom and a top, wherein a height of the band between the bottom and the top is greater in a front of the band than it is in a back of the band; and another zipper half on the bottom of the elastic band that interacts with the zipper half on the inside of the waistband to connect the bottom of the elastic band to the inside of the waistband of the article of clothing;

wherein the article of clothing can be worn by the pregnant woman early in pregnancy and the band can be added to the article of clothing for wear later in pregnancy by connecting the zipper half on the inside of the waistband to the zipper half on the bottom of the elastic band so that the front of the elastic band is disposed at the front of the garment and pulling the elastic band over the inside of the waistband and over the pregnant woman's belly.

2. The garment of claim 1, wherein said elastic band is a stretch-type material.

3. The garment of claim 1, wherein said elastic band is spandex.

4. The garment of claim 1, further comprising a means to elastically reinforce said top of the elastic band, wherein said means is selected from the group consisting of another elastic band and a stronger elastic weave near said another edge.

5. The garment of claim 1, wherein said waistband further comprises at least one elastic buttoned tab to further expand the waistband as the belly of the wearer grows.

6. The garment of claim 1, wherein material of a body of said garment is gathered at said each side of the garment proximate said elastic pieces to accommodate changes to the pregnant women's hips and pelvis.

7. The garment of claim 1, wherein a rear of said waistband is narrower than said central stiffened panel.

* * * * *